US006811214B2

(12) United States Patent
Williams

(10) Patent No.: US 6,811,214 B2
(45) Date of Patent: Nov. 2, 2004

(54) SOFA LOVERS SOFA

(76) Inventor: Kevin M. Williams, 35 McGrath Dr., Middletown, CT (US) 06457

( * ) Notice: Subject to any disclaimer, the term of this patent is extended or adjusted under 35 U.S.C. 154(b) by 0 days.

(21) Appl. No.: 09/758,660

(22) Filed: Jan. 12, 2001

(65) Prior Publication Data

US 2002/0093227 A1 Jul. 18, 2002

(51) Int. Cl.[7] ..... A47C 13/00
(52) U.S. Cl. ..... 297/116; 5/59.1
(58) Field of Search ..... 5/52, 53.2, 59.1; 297/115, 116, 117, 411.23, 411.24, 411.3, 411.31, 411.35, 411.37, 353, 354.12

(56) References Cited

U.S. PATENT DOCUMENTS 863,874 A * 8/1907 Rajner ..... 297/115
2,610,329 A * 9/1952 Strathaus ..... 5/59.1
2,642,585 A * 6/1953 Piliero ..... 5/59.1
2,679,653 A * 6/1954 Blanke et al. ..... 5/59.1 X
2,866,496 A * 12/1958 Glass ..... 5/52 X
3,248,742 A * 5/1966 Johnson ..... 5/59.1 X
3,419,921 A * 1/1969 Flood ..... 5/52 X
5,517,706 A * 5/1996 Kashima et al. ..... 5/53.2 X

* cited by examiner

*Primary Examiner*—Peter M. Cuomo
*Assistant Examiner*—Stephen Vu
(74) *Attorney, Agent, or Firm*—Nath & Associates PLLC; Marvin C. Berkowitz; Derek Richmond

(57) ABSTRACT

A sofa or the like has an end cushion comprising a lower stationary member approximating the height of an arm of the sofa and a rotatable upper member that may be rotated to overlie an arm of the sofa. Thus, a back support may be provided for sitting crosswise on the sofa.

7 Claims, 2 Drawing Sheets

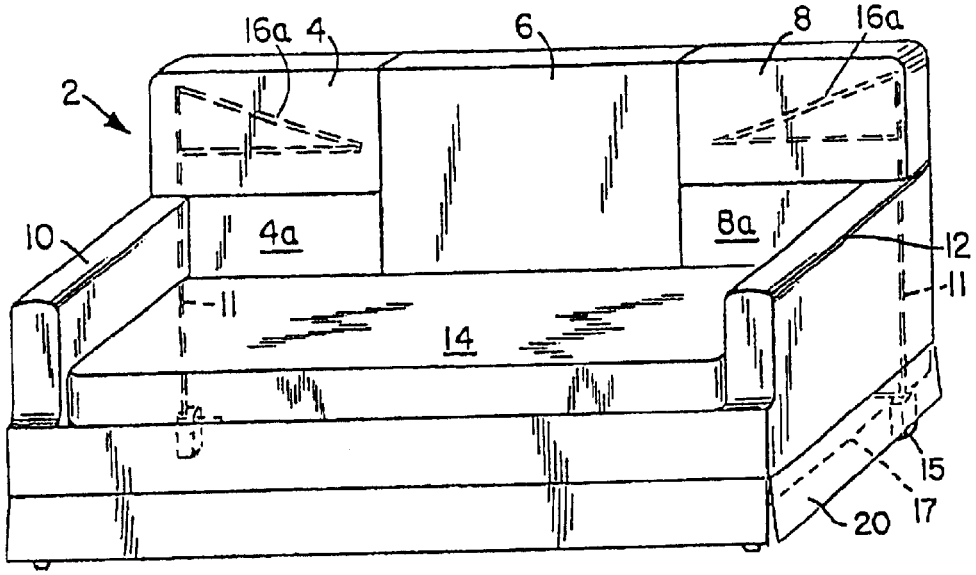
Fig.1
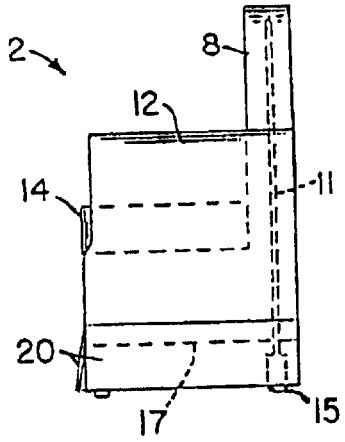
Fig.2
Fig.3
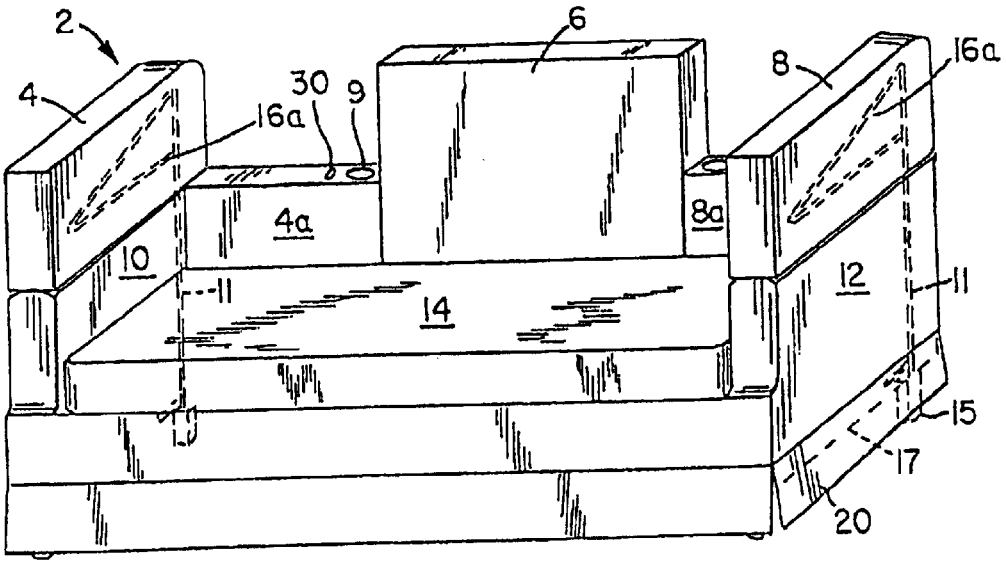

SOFA LOVERS SOFA

FIELD OF THE INVENTION

The present invention relates to adjustable sofas and more particularly to a sofa in which members of the back rest of the sofa may be rotated such as to raise the height of one or both of the arms of the sofa to provide support for the back, neck and head and enhance comfort when lying across the sofa with the persons legs lying on the seat cushions of the sofa.

BACKGROUND OF THE INVENTION

People often lie across a sofa; that is, from arm to arm, at times for comfort and at times when viewing TV or conversing with someone located generally parallel to the sofa, or both seated likewise on the sofa, facing each other. The arms of the sofa are generally not very high so that the head of the user is not supported by any portion of the sofa if the person is sitting upright. The only option typically is to slouch on the couch, or use multiple pillows (oversized ones, if available) for lower to mid-back support, but even then the person's head and neck are left unsupported.

BRIEF DESCRIPTION OF THE INVENTION

In accordance with one embodiment of the present invention, a sofa having a three cushion back and arm rests permits the two lateral end back rest cushions (or only one as desired) to be rotated into positions overlying the typical sofa arm rests and locked in such positions vertically.

In such an arrangement one or both of the back cushions on the two sides of the middle cushion provide a back rest or, depending on the height of the seated person, a raised headrest.

In such an instance, with both typical arm areas effectively elevated, a couple may lie on the sofa facing one another, each with a backrest. The non-rotating section of the lateral rear cushion(s) provides(s) a natural, new arm rest for the rear most arm of each person when seated lengthwise on the couch. The rotating backrest when added to the typical arm provides a new back rest much as the normal (typical) back of the sofa.

The above and other features, objects and advantages of the present invention, together with the best means contemplated by the inventor thereof for carrying out the invention will become more apparent from reading the following description of a preferred embodiment and perusing the associated drawings in which:

BRIEF DESCRIPTION OF THE DRAWINGS

FIG. 1 is a front view in perspective of a three cushion sofa according to the present invention;

FIG. 2 is a side view of the sofa;

FIG. 3 illustrates a front view in perspective of the sofa with the two end back members rotated to overlie the typical arms of the sofa;

DETAILED DESCRIPTION OF THE PRESENT INVENTION

Figure 4:
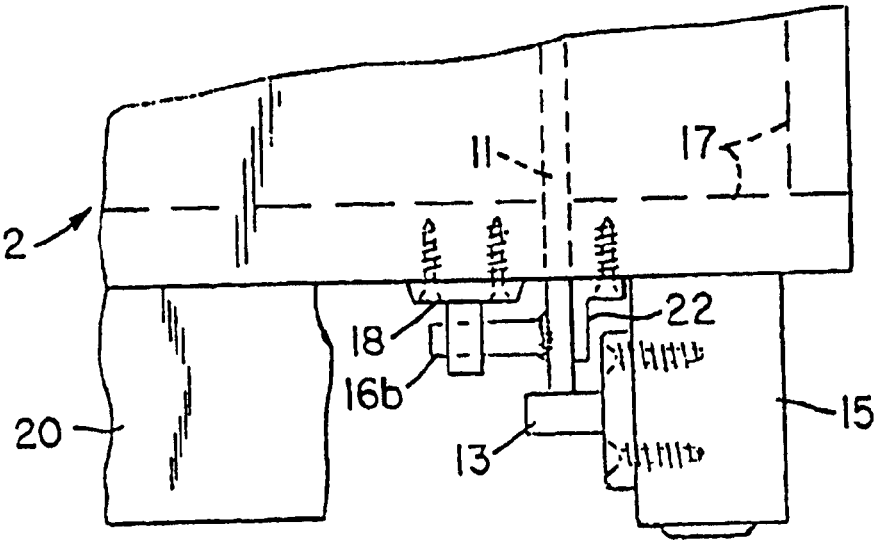
FIG. 4 illustrates a side view of one embodiment of the invention.

Referring now to FIGS. 1 and 2 of the accompanying drawings, a sofa 2 has three back cushions, the two outer most cushions being composed of two parts. These cushions include stationary lower members 4*a* and 8*a* and rotatable upper members 4 and 8, and a single center non-rotating back cushion 6. Members 4, 4*a* and 8, 8*a* are the outward most cushions. Rotatable upper members 4 and 8 can rotate to rest on top of standard sofa arms 10 and 12. Stationary lower members 4*a* and 8*a* are of the same height as the standard sofa arms 10 and 12. The remainder of the sofa is of standard design having a simple seat cushion 14, fabric skirt 20, legs 15 and a frame 17 supporting the members set forth above.

Rotatable upper members 4 and 8 of the outer most cushions may be rotated into the positions shown in FIG. 3; that is, overlying the arms 10 and 12 with the center cushion 6 remaining in its initial position. As can be seen in FIG. 3, the new configuration of the arms and rotatable upper members (4 and 8) provide a high back at the sides of the sofa; the height being the combined height of the arms and of the rotatable members rotated into position over the arms. In the drawings the height of the arms plus rotatable members provides a back at the same height as the center cushion 6. Such is not essential since the height of rotatable members 4 and 8 do not have to be as high as that of center cushion 6.

In lower members 4*a* and 8*a*, a cup holder recess 9 and a pencil holder 30 are provided.

Figure 5:
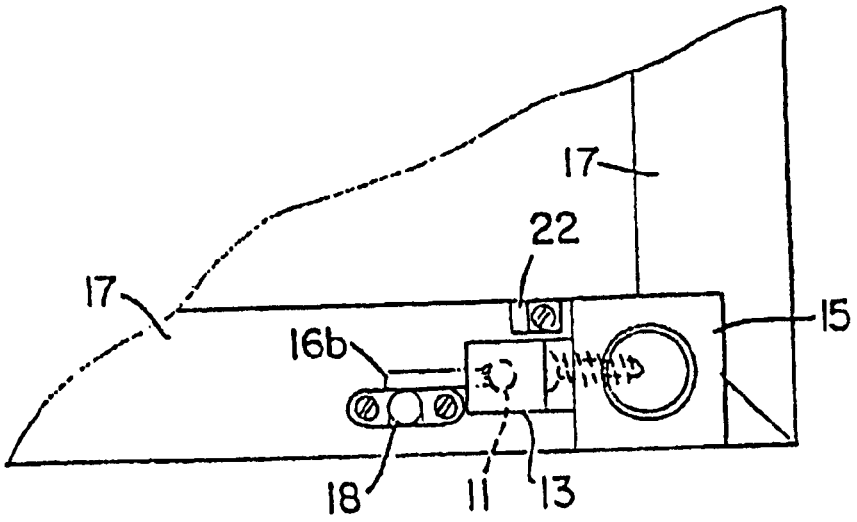
FIG. 5 illustrates a bottom view of one embodiment of the invention.

Referring now to FIGS. 4 and 5, a rod 11 extends from adjacent the bottom of the sofa through the sofa arms 10 and 12 and into the lateral parts of upper members 8 and 4 that are to be rotated. The rod 11 may be supported at its lower end by a support plate 13 secured to a leg 15 of the sofa. This same description applies to rod 11 as displayed in FIGS. 1 and 3 on both sides of the sofa. Rigid cushion rod 16*a* is attached to an upper end of rod 11 and extends into respective rotatable members 4 and 8. The rod 11 carries at its lower end a lateral extension 16*b*, that is a rigid, lateral extension from rod 11 that engages a metal stop 18 secured to the frame of the sofa. The support plate 13 and stop 18 are located behind a skirt 20 of the sofa so as not to be visible. Other means of support are available, of course. The rod 11 could have a circular shoulder that rests on top of a ring plate not shown secured to the frame or a leg.

When the rotatable member 8 is in its standard position it is lying overtop of lower member 8A, held secure by the lateral extension 16*b* of rod 11 that in turn engages stop 22. The rotatable member 8 is held securely in place by the combination of the lateral extension 16*b* the rigid cushion rod 16*a*, and the stop 22. Similarly, the cooperation of the lateral extension 16*b*, rod 11 and stop 18 hold the rotatable member securely over the arm 12.

In order for the structure to accomplish its intended purpose, the height of the lower member 8A is preferably the same height as the arm 12 so that the rotatable member 8 lies directly on top of the arm 12. The length of the arm 12 and the width of rotatable member 8 in its normal position do not have to be the same; one can be longer or shorter than the other, with the arm length preferably just as long as the rotating portions of the sofa covers or longer.

Although the description is applied only to rotatable member 8 of the sofa it applies with equal validity to rotatable member 4 if it is desired to have both sides of the sofa to be adjustable and the same. A sofa having only one rotatable member is also contemplated. In addition, it is obvious that latches could be formed where rotatable member 8, for instance contacts center cushion 6.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A sofa comprising a back having several cushions including at least one end cushion and another cushion, a seat cushion, an arm located on at least one side of the seat cushion, a frame and front and rear legs extending downwardly from said frame, a rod rising generally vertically from adjacent at least said rear leg, through said frame and into an interior of said end cushion adjacent a lateral edge of the end cushion remote from said another cushion of said back, means for supporting said rod for rotation, said end cushion is comprised of a stationary lower section and an upper section that moves with said rod, means for causing said end cushion to rotate with said rod between a first position in line with said another cushion; and a second position overlying said arm, and means for limiting rotation of said end cushion to between said first and said second positions.

2. The sofa according to claim 1 wherein said sofa is a three cushion sofa with both end cushions of the back of the sofa rotatable to positions overlying the arms of the sofa.

3. The sofa according to claim 1 wherein said means for rotating includes a plate for said rod secured to a selected one of said legs and said frame, said rod carrying adjacent a lower end of the rod, a lateral extension, a first stop member engageable by said lateral extension when the cushion is in line with said another cushion, and a second stop engaged by said lateral extension when the cushion overlies said arm.

4. The sofa according to claim 3 further comprising a cushion rod extending from said rod through a sufficient region of said cushion to maintain said cushion in a location determined by the rotational position of said rod.

5. The sofa according to claim 1 wherein said rod passes through said frame and is stabilized thereby.

6. The sofa according to claim 1 wherein said lower section has a height generally equal to the height of said arm.

7. The sofa according to claim 1 wherein said upper section rises a predetermined height above said arm.

* * * * *